United States Patent [19]

Santefort

[11] Patent Number: 4,597,721

[45] Date of Patent: Jul. 1, 1986

[54] DOUBLE ACTING DIAPHRAGM PUMP WITH IMPROVED DISASSEMBLY MEANS

[75] Inventor: Richard A. Santefort, Hamilton, Ohio

[73] Assignee: Valco Cincinnati, Inc., Cincinnati, Ohio

[21] Appl. No.: 784,241

[22] Filed: Oct. 4, 1985

[51] Int. Cl.[4] ..... F04B 17/00

[52] U.S. Cl. ..... 417/393; 417/454; 91/275; 91/341 R; 92/128

[58] Field of Search ..... 417/393, 454; 91/329, 91/323, 341 R; 92/167, 258, 128; 403/300, 306

[56] References Cited

U.S. PATENT DOCUMENTS

| | | | |
|---|---|---|---|
| 3,439,938 | 4/1969 | Dunton | 403/306 X |
| 3,782,863 | 1/1974 | Rupp | 417/393 |
| 3,791,768 | 2/1974 | Wanner | 417/393 |
| 3,849,033 | 11/1974 | Schall | 417/454 |
| 4,247,264 | 1/1981 | Wilden | 417/393 |

FOREIGN PATENT DOCUMENTS

| | | | |
|---|---|---|---|
| 201804 | 8/1923 | United Kingdom | 403/300 |

*Primary Examiner*—Leonard E. Smith
*Attorney, Agent, or Firm*—Frost & Jacobs

[57] ABSTRACT

A double-acting air-powered diaphragm pump having a pair of identical pump assemblies detachably secured within a frame-like manifold assembly. Each of the pump assemblies contains a pair of mating halves and a web-like resilient diaphragm defining an air cavity and a fluid cavity. Each of the diaphragms is operated by means of a centrally attached shaft, the facing ends of the shafts being joined by a chain link which allows for potential misalignment. The pump assemblies, which are substantially identical in construction, may be easily and individually removed from the manifold assembly for repair or replacement.

16 Claims, 4 Drawing Figures

DOUBLE ACTING DIAPHRAGM PUMP WITH IMPROVED DISASSEMBLY MEANS

BACKGROUND OF THE INVENTION

The present invention is directed to a diaphragm pumping apparatus. The invention is more specifically directed to an improved construction of a reciprocating air driven double acting diaphragm pump.

Air driven diaphragm pumps are widely applied in construction and industrial applications. The pumps can be made to be durable and reliable and they have the major advantage that they can handle a wide variety of fluids to be pumped. Regardless of the application to which such a pump is put, the amount of energy consumption associated with operating the pump and the ease with which the pump can be maintained are two matters of great concern to its user.

Many of the prior art diaphragm pumps show little attention to these considerations. Examples of such pumps include U.S. Pat. No. 3,838,946 issued to Schall, U.S. Pat. No. 4,008,984 issued to Scholle and U.S. Pat. No. 4,247,264 issued to Wilden. These three patents disclose air driven diaphragm pump mechanisms. Each of them include an opposing set of pump chambers linked by a solid shaft. In all three designs, a relatively large amount of compressed air must be supplied during each cycle to the control and supply lines which feed the pump chambers to operate the pump. The energy efficiency of such a pump relates directly to the quantity of air consumption with each pump stroke. Therefore, a well designed diaphragm pump would minimize this quantity.

Of even greater concern to the pump operator is the effort required to perform routine maintenance and parts replacement. The ease of maintenance is greatly affected by the manner in which the individual pump components are assembled and held in place. Of particular concern is the accessibility of the pumping chambers and diaphragms. The diaphragms, which alternately expand and contract the pumping chamber, undergo numerous flexure cycles and significant abrasion during their operation, and thus must periodically be replaced or repaired. Consequently, the ability to access the pumping chamber and the individual diaphragms to perform this maintenance has a great impact on the ease or difficulty of maintenance of air driven diaphragm pumps.

The prior art teaches a variety of approaches to the maintenance problem. The Scholle patent shows a pump in which the operating chambers and supporting structure are provided in a single casting. End caps secured to the casting are removable to replace the pump diaphragms located near the outer ends of the pump.

The Schall patent shows a pump assembly which, when viewed from above, comprises two pump chambers surrounded by plumbing. That structure rests on a support beam which is co-axial with the pump chambers. To replace a pump chamber diaphragm, the bolts holding that pump chamber are removed and the surrounding pipes are disconnected.

The Wilden design also points up the problems inherent in pump disassembly and replacement of the diaphragm. As a solution, Wilden adopts a pump configuration which completely disassembles with the removal of four tie rods.

In addition to efficiency and maintenance considerations, further design concerns arise from diaphragm pumps being operated in dirty environments. In such applications, it is important that the pump design guard against the effects of the inevitable air supply contamination. Even slight amounts of dirt or oil in the air supply easily can interfere with the typical control systems or air supplies which operate the diaphragm pump. Unless care is taken in the design of the pump to accommodate such environments, the reliability and smooth operation of the pump will suffer.

Many industrial process applications call upon diaphragm pumps to supply a fluid substance to a process location on demand. For example, the pump might be used to pump glue to a particular application point in a process line. In such an application, all of the operational and design concerns mentioned above are important. In addition, it becomes very important under such circumstances that the pump provide smooth consistent operation even when being operated slowly. Because of transient conditions that occur when the reciprocating shaft of the pump reverses directions, many air driven diaphragm pumps do not provide smooth consistent operation at low speeds. Such diaphragm pumps are also susceptible to binding when operated under conditions of low operating pressure due to potential misalignment between the single shaft connecting the pump chambers and the bearing surfaces upon which the shaft rides. Furthermore, such pumps may be prone to pressure and flow surges resulting from dirt or oil in their air-operated control system or resulting from the lag time for shaft reversal in the case of designs which place the air supply control valve at a significant distance from the pump chambers. In a process line in which the pump is supplying a liquid such as glue, for example, such pressure and flow rate surges will cause surges in the glue flow, an obviously unacceptable condition. A well designed diaphragm pump must take all of these factors into account.

SUMMARY OF THE INVENTION

It is an object of the present invention to provide an improved structural design which simplifies the manufacture and maintenance of diaphragm pumps. A further object of the present invention is to provide a configuration which ensures smooth and consistent operation even at times when the demand is relatively low and the pump is operating slowly. An additional object of the present invention is to provide a diaphragm pump with a low air consumption rate and an improved ability to tolerate dirty operating environments.

Specifically, the present invention provides a new configuration and operating means for air driven diaphragm pumps. The basic pump configuration contains opposed pump cavities and diametrically opposed inlet and outlet ports which communicate with each of the opposed pump cavities. The opposed pump cavities are mounted within a self-standing, rigid rectangular manifold. The manifold contains check valves and provides the means for the pumped fluid to move from the inlet port to the outlet port via the pump cavities. The air supply valves for each of the pump cavities are mounted directly adjacent the pump cavities and are electronically controlled to provide precise reversal and air supply actuation. Each of the opposing pump assemblies includes its own drive shaft. The drive shafts are connected by a non-rigid joining means. The pump consists of a simplified symmetrical construction and each of the pump chambers may be readily serviced by removing four bolts. Further features of the invention will beacome apparent from the detailed description which follows.

DETAILED DESCRIPTION OF THE PREFERRED EMBODIMENT

Figure 1:
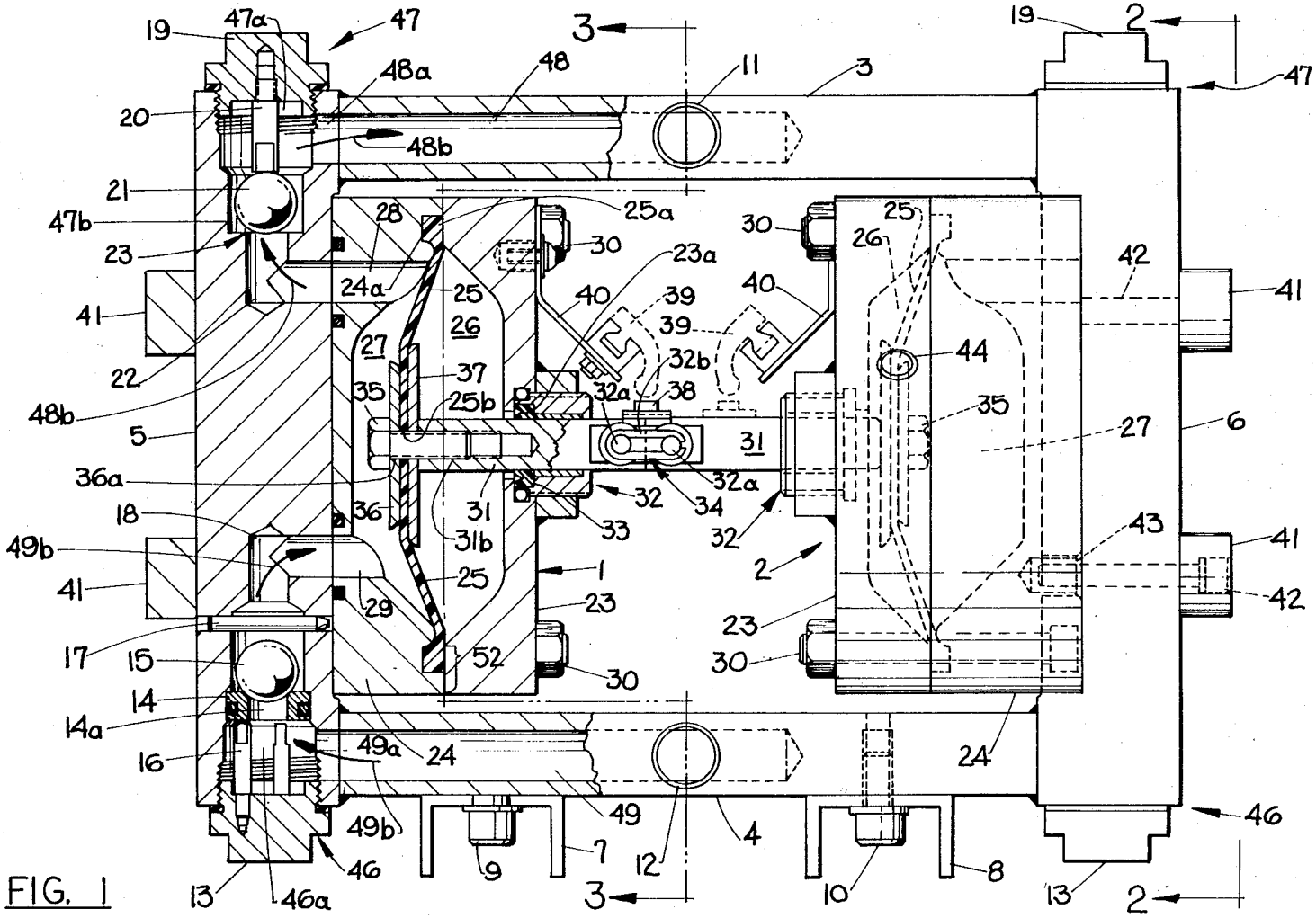
FIG. 1 is a cutaway partially cross sectional side elevational view of the diaphragm pump of the present invention.
Figure 2:
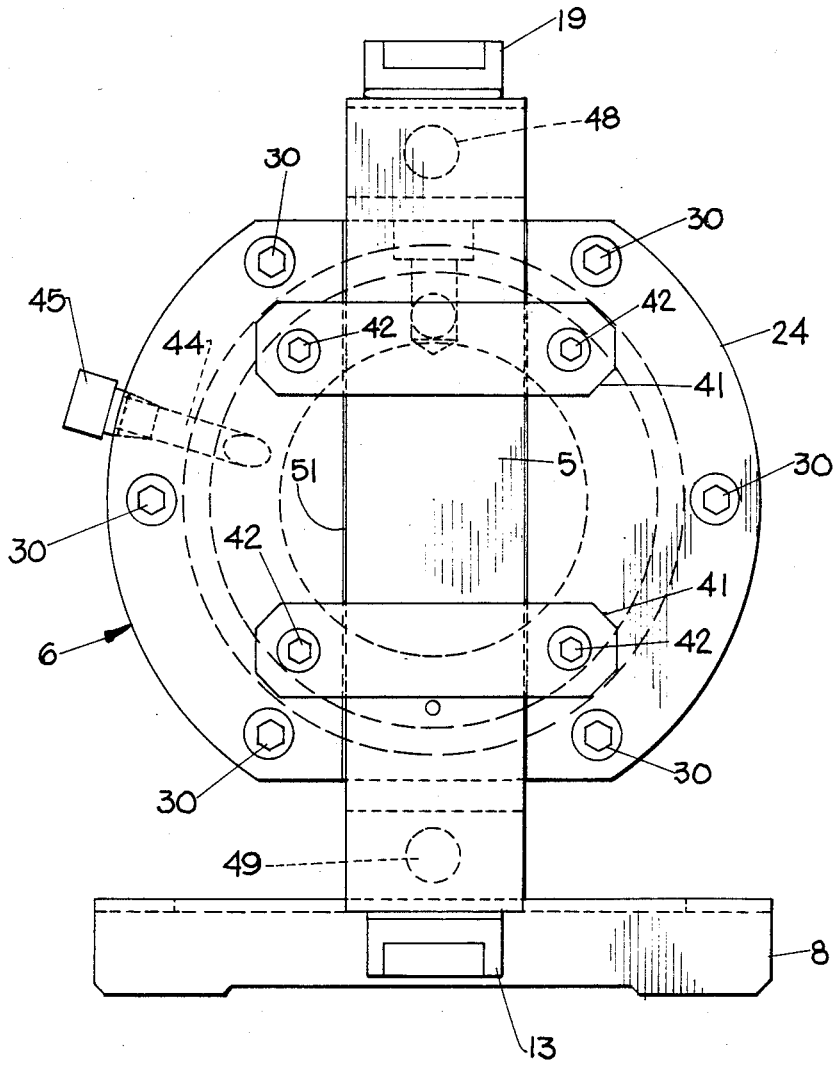
FIG. 2 is an end elevational view of the pump of the present invention as viewed in the direction of arrows 2—2 in FIG. 1.
Figure 3:
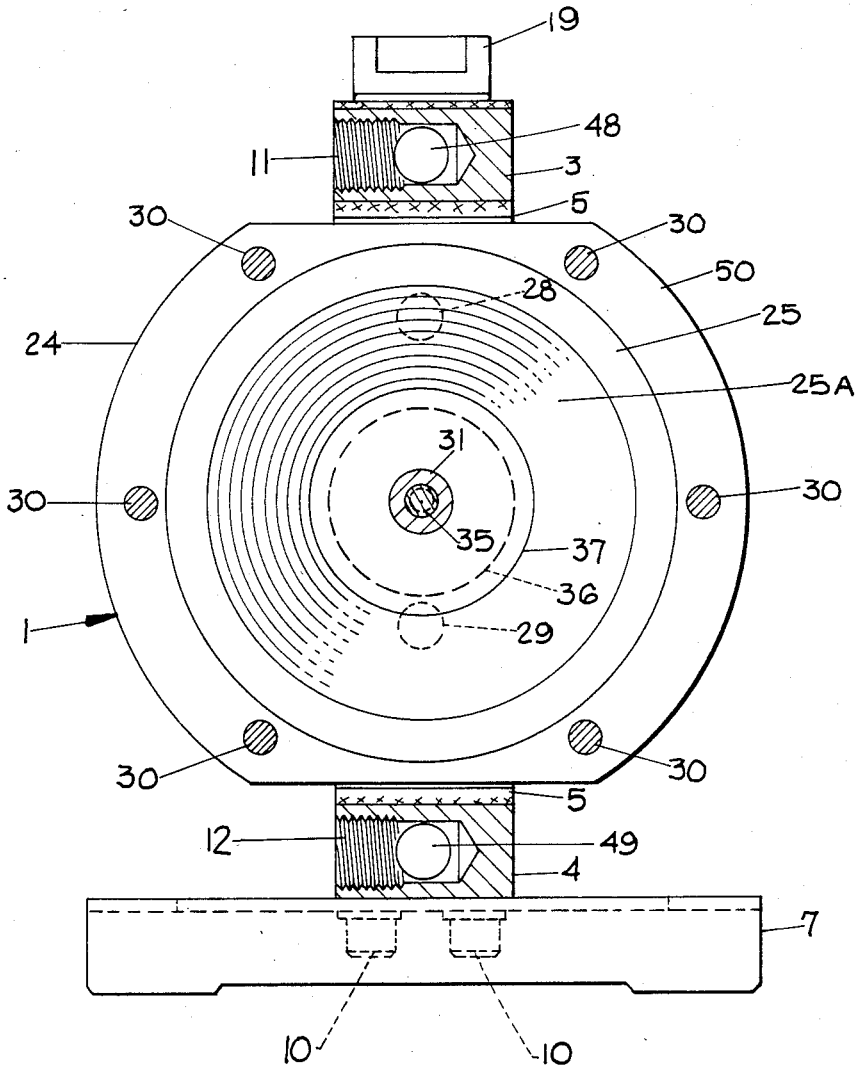
FIG. 3 is a sectional view taken along line 3—3 of FIG. 1.

The diaphragm pump of the present invention is shown in a partially cross-section side elevational view in FIG. 1. The pump consists of two substantially similar opposing pump assemblies 1 and 2 held within a rigid self-standing frame-like rectangular manifold assembly. The manifold assembly is formed by upper and lower horizontal longitudinally extending vertically spaced parallel manifold tubes 3 and 4, respectively, which may be of any desired cross-sectional shape, and are hollow to permit the passage of fluid therethrough. For purposes of an exemplary showing, and as best seen in FIG. 2, the internal passageway of the upper and lower manifold tubes is of circular cross section as best shown in FIG. 3.

The ends of the frame-like manifold assembly are formed by vertically extending plate-like end members 5 and 6 which extend between and are rigidly attached to the opposite ends of upper and lower manifold tubes 3 and 4.

It will be observed that pump assembly 1 is attached to the inner surface of end member 5, while pump assembly 2 is similarly attached to the inner surface of end member 6. Spaced parallel transversely extending feet members 7 and 8 are rigidly secured at their mid-points to the lowermost surfaces of lower manifold tube 4 by vertically extending bolts 9 and 10 which threadedly engage cooperating bores in lower manifold tube 4.

As will become apparent from the detailed description which follows, the construction of the left-hand portion of the pump as viewed in FIG. 1 is substantially identical to the construction of the right-hand portion of the pump. That is, the pump is substantially symmetrical about its vertical center line except as otherwise noted herein.

Upper manifold tube 3 includes a longitudinally extending interior passageway 48, while lower manifold tube 4 includes a similarly constructed interior passageway 49. Upper manifold tube 3 also includes a centrally located outlet port 11 which communicates with the interior passageway 48. Lower manifold tube 4 is provided with a centrally located inlet port 12 which communicates with interior passageway 49.

Each of end members 5 and 6 is provided with an inlet check valve assembly 46 at the bottom end thereof, and an outlet check valve assembly 47 at the top end each of which serve to limit the flow of pump fluid to one direction.

Inlet check valve assembly 46 includes a vertically extending cylindrical bore **46*a* in the lowermost portion of end members 5 and 6 which communicates with lower passageway 49 as at 49*a*. A check valve is positioned within interior bore 46*a* and comprises an annular resilient valve seat 14 having a central opening 14*a*. The check valve is opened and closed by means of a freely movable spherical ball 15 which is positioned above seat 14 and dimensioned to close opening 14*a***.

Seat 14 is retained in position by three vertically oriented support pins, one of which is shown at 16.

The check valve assembly is retained in position by means of a closure 13 which threadedly closes the lowermost end of bore **46*a* and serves to support the lower end of support pins 16. It will be understood that the support pins, seat and ball may be withdrawn from the check valve assembly by removing lower closure 13**.

In operation, the intake check valve assemblies 46 permit fluid to flow from inlet port 12 and through internal manifold passageway 49 only in the direction of directional arrow **49*b*. The fluid pressure causes ball 15 to move upwardly and unseat from seat 14 until stopped by a horizontally extending stopper pin 17 which is positioned across the upper end of bore 14*a*. The fluid is exhausted from the check valve assembly through a passageway 18 in the end members 5 and 6. As best shown in FIG. 1, the lowermost end of passageway 18 communicates with the upper end of bore 14*a*, while the outlet end of passageway 18 communicates with the interior of the fluid region 27 to be described in more detail hereinafter. It will also be observed that attempted fluid flow against the direction of directional arrows 49*b* will cause ball 15 to seat tightly against seat 14, thereby preventing flow through opening 14*a*** of the seat.

The construction and operation of outlet valve assemblies 47 located at the uppermost ends of end members 5 and 6 is similar to that previously described for the inlet check valve assemblies. Each upper check valve assembly 47 includes a vertically extending cylindrical bore **47*a* in the uppermost portion of the end members which communicates with upper passageway 48 as at 48*a*. A check valve comprising the lower portion of bore 47*a* terminates in a bore 47*b* of larger diameter, the lowermost end of which forms a valve seat 23. A freely movable spherical ball 21 is entrained within bore 21. An elongated generally cylindrical stopper pin 20 is retained within bore 47*a*, and is of such a length so as to prevent substantial upward movement of ball 21, thereby maintaining a clear flow path between bore 47*b* and 47*a*. The upper end of bore 47*a* is closed by means of a closure 19 which is threadedly engaged in the upper end of end member 5**.

In operation, upper check valve 47 permits the flow of fluid from the fluid region 27 through passageway 28 into manifold passageway 48 only in the direction of directional arrows **48*b*. In the event of attempted fluid flow in the opposite direction, ball 21 will be pressed tightly against valve seat 23, thereby closing passageway 28** and preventing fluid flow in this direction.

Consequently, lower check valve assembly 46 permits fluid flow only from inlet port 12 into the fluid region 27, while upper check valve assembly 47 only permits fluid flow from the fluid region 27 to outlet port 11, as described hereinafter.

The pump assembly 1 is fixedly but removably attached to the inner surface of end plate 5, while pump assembly 2 is fixedly but removably attached to the inner surface of end plate 6. In the exemplary embodiment shown, it will be understood that the construction of pump assembly 2 is substantially identical to that of pump assembly 1, so that only the construction of pump assembly 1 will be described in detail.

Pump assembly 1 includes a plate-like concave pump housing 23 and an outer plate-like concave pump housing 24. Pump housings 23 and 24 mate along their inner surfaces to form an annular contact area 50, as best shown in FIG. 3. The pump housings are secured together by means of 6 circumferentially spaced through-bolts 30 which extend through cooperating holes in the pump housings.

Pump assembly 1 also is provided with a circular resilient web-like diaphragm 25 which has an outer peripheral bead 25*a* which is entrained in a cooperating circumferentially extending groove 24*a* provided on the outermost surface of outer pump housing 24, as can best be seen in FIG. 1. When the inner and outer pump housings 23 and 24, respectively, are mated together, the bead portion 25*a* of diaphragm 25 is pressed tightly into groove 24*a* in order to secure the diaphragm between the mated pump housings.

As can best be seen in FIG. 1, the volume formed by the concavities of inner pump housing 23 and outer pump housing 24 defines a pumping chamber which is bisected by resilient diaphragm 25 into an air region 26 and a fluid region 27. As noted hereinabove, passageway 28 communicates between fluid region 27 and the upper check valve assembly 47, while passageway 29 communicates between the fluid region 27 and lower check valve assembly 46.

Inner pump housing 23 is provided with a centrally located through bore or opening 23*a* which slidingly and sealingly restrains a reciprocable connecting shaft 31 which is connectd at one end to the diaphragm 25 as will be explained in more detail hereinafter, and at the other end to the innermost end of shaft 31 associated with pump assembly 2. The inner surface of pump housing 23 is also provided with a bushing assembly 32 and annular seal 33 which serve to support shaft 31 and prevent the escape of air from within air region chamber 26 as the shaft is reciprocated.

As can best be seen in FIG. 1, the innermost ends of the shafts associated with pump assemblies 1 and 2 are joined together by means of a chain link assembly 34 or any other suitable connecting means which provides two degrees of freedom of movement between the shafts 31. In the exemplary embodiment illustrated in FIG. 1, each of shafts 31 has a transversely extending hub or pin 32*a* near its inner end. Hubs 32*a* are joined together by a rigid chain link 32*b* which forms the chain link assembly 34 to permit relative movement between the shaft ends in order to accomodate potential misalignment of the shafts.

The opposite or outer ends of shafts 31 are provided with means for attaching the shafts to the central portion of resilient diaphragm 25. In the preferred embodiment illustrated, a round annular-shaped washer 36 containing a central opening 36*a* is positioned on the outer surface of diaphragm 25 coaxial with shaft 31. A similar annular-shaped washer 37 of larger diameter than washer 36 is positioned on the inner surface of diaphragm 25, also coaxial with shaft 31. A bolt 35 passes through the openings in washers 36 and 37, through a suitably sized opening 25*b* in the central portion of the diaphragm, and threadedly engages a threaded bore 31*b* extending coaxially within shaft 31. Bolt 35 is then tightened so as to securely squeeze the central portion of diaphragm 25 between washers 36 and 37 so that the diaphragm moves with the reciprocating motion of shaft 31. Thus, as the shaft is reciprocated as will be described hereinafter, the volumes of air region 26 and fluid region 27 will be alternately increased and decreased.

A small magnet or other suitable triggering device 38 is fixedly attached to the outer surface of either of shafts 31 adjacent its innermost end. A magnetic sensor, shown schematically at 39, is mounted to the inner surface of each of pump assemblies 1 and 2 by means of a angled mounting bracket 40 or other suitable mounting means. It will be understood that magnetic sensor 39 may comprise a magnetic reed switch or any other means suitable to provide a contact closure upon proximate passage of magnet 38. Sensor 39 is positioned adjacent the outer surface of shafts 31 so that as magnet 38 passes near the sensor, a suitable electrical signal will be produced for reversing the direction of travel of the shaft 31 as will be described in more detail hereinafter in connection with the control system illustrated in FIG. 4.

As can be seen in FIG. 2, the outer surface of the outer pump housing 24 includes a vertically extending groove 51 which is dimensioned to accept vertically extending end member 5 or 6 as the case may be. The outer pump housing 24 is held to vertically extending member 5 or 6 by means of a pair of horizontally extending vertically spaced retainer bars 41 which abut the outer surface of end member 5 or 6, and which are secured to the outer surface of the outer pump housing 24 by means of a pair of retainer bolts 42.

Each of the pump assemblies is provided with a radially extending air access passageway 44 which communicates with air region 26 of the pump assembly. A solenoid operated three-way air valve 45 (see FIG. 2) of conventional construction threadedly engages the outer end of passageway 44. As will be described in more detail hereinafter, air valve 45 operates to control flow of pressurized air into air region 26 so as to alternately move diaphragm 25 to cause reciprocating motion of shafts 31.

Figure 4:
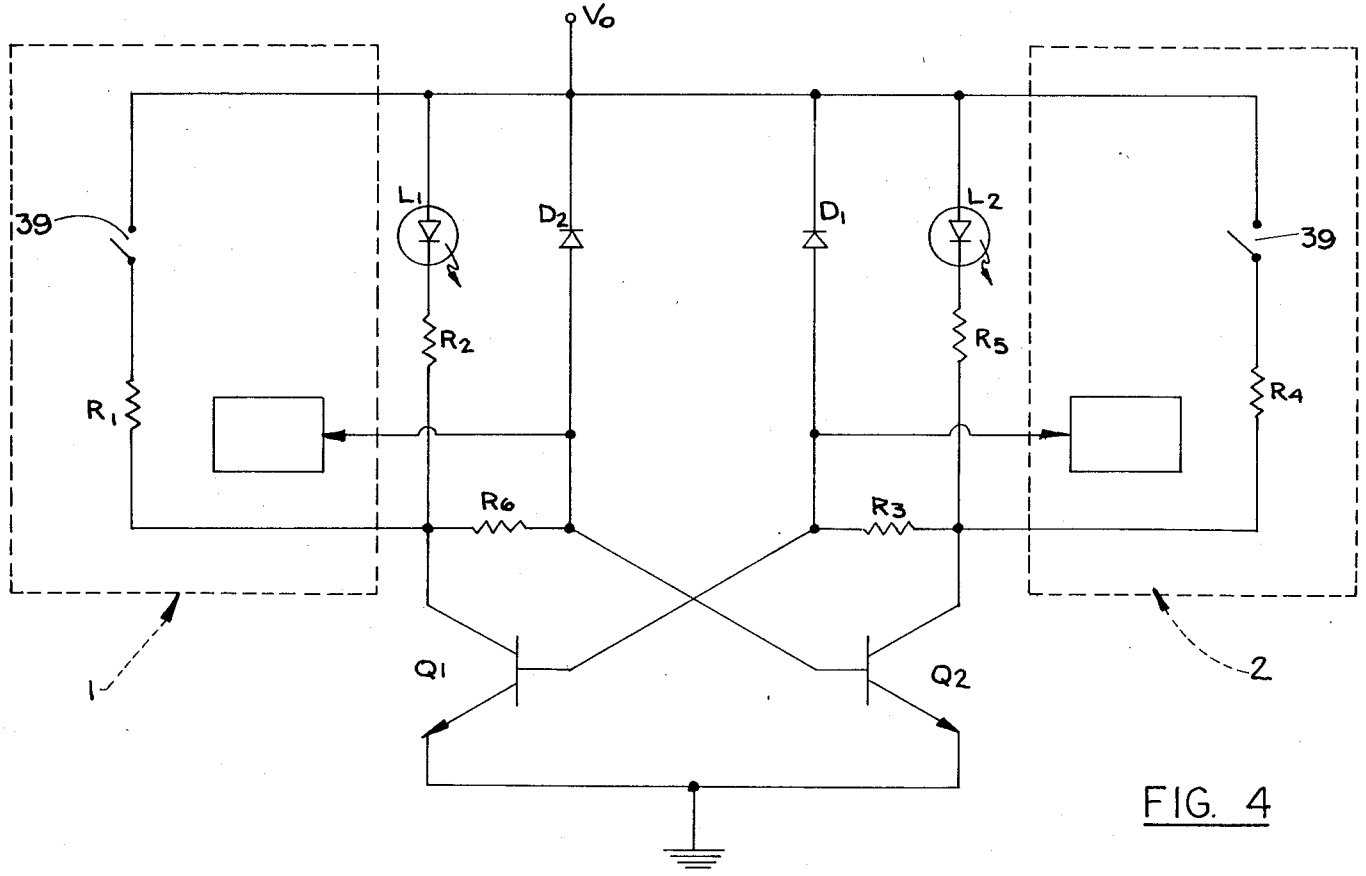
FIG. 4 is an electrical schematic diagram of the control system of the diaphragm pump of the present invention.

The electrical control system of the diaphragm pump of the present invention is illustrated in FIG. 4. The central system includes a flip-flop stage which is formed by a pair of cross-connected transistors $Q_1$ and $Q_2$. The emitters of both transistors are returned to ground. The collector of transistor $Q_1$ is connected through a resistance $R_1$ and normally open proximity switch 39 associated with pump assembly 1 to a source of DC voltage $V_0$. The collector of transistor $Q_1$ is also connected to the serial combination of a resistor $R_2$ and light emitting diode $L_1$. The base of transistor $Q_1$ is connected through a reverse biased diode $D_1$ to voltage supply $V_0$, to the solenoid associated with three-way valve 45, and through resistor $R^3$ to the collector of transistor $Q_2$.

Similarly, the collector of transistor $Q_2$ is connected through resistor $R_4$ and normally open proximity switch sensor 39 associated with pump assembly 2 to voltage source $V_0$. The collector of transistor $Q_2$ is also connected through the serial combination of resistor $R_5$ and light emitting diode $L_2$ to the voltage supply. The base of transistor $Q_2$ is connected to the voltage supply through a reverse biased diode $D_2$, to the solenoid of the three-way valve 45 associated with pump assembly 1, and through resistor $R_6$ to the collector of transistor $Q_1$.

To describe the operation of the pump, it will be assumed that transistor $Q_1$ is initially energized so that the solenoid associated with three-way valve 45 of pump assembly 1 is turned on. At the same time, light emitting diode $L_1$ is illuminated to show this condition. When magnetic proximity switch sensor 39 is associated with pump assembly 1 is momentarily closed, transistor $Q_2$ will be turned on and transistor $Q_1$ will be turned off. Under this condition, the solenoid associated with three-way valve 45 of pump assembly 2 will be turned on, as well as light emitting diode $L_2$. Likewise, when magnetic proximity switch sensor 39 associated with pump assembly 2 is momentarily closed, transistor $Q_1$ will be turned on and transistor $Q_2$ will be turned off, thereby turning on the solenoid associated with three-way valve 45 of pump assembly 1, as well as light emitting diode $L_1$. In this way, each of the three-way valves is alternately turned on and off as magnet 38 alternately passes each of magnetic proximity sensors 39.

The operation of the entire diaphragm pump will now be described. As shown in FIG. 1, shafts 31 have moved to their furthest leftmost position. As this occurs, the proximity sensor 39 associated with pump assembly 1 detects magnet 38. This causes sensor 39 to close, thereby turning on transistor $Q_2$ to turn the solenoid associated with the three-way valve of pump assembly 1 off, and the solenoid associated with the three-way valve of pump assembly 2 on. As this occurs, air is exhausted through the left-hand three-way valve, but at the same time, air under pressure is permitted to enter the right-hand three-way valve from a source of air pressure, not shown. As this occurs, air is exhausted from the air region 26 associated with the left-hand pump assembly of FIG. 1, while air begins to enter the air region 26 associated with the right-hand pump assembly. The increased air pressure in the right hand air region presses against the innermost surface of diaphragm 25, causing that diaphragm to move to the right and carry with it the attached shaft 31. This action causes the left-hand diaphragm to be pulled to the right, which also assists in exhausting air through the right-hand three-way valve from the air region 26 associated with pump assembly 1.

As this occurs, the pressure differential resulting from the increased volume of fluid region 27 of pump assembly 1 causes fluid to be drawn into inlet port 12 through the left-hand lower check valve assembly 46. At the same time, the decrease in volume of the fluid region 27 associated with pump assembly 2 causes fluid to be exhausted from the right-hand pump assembly through the upper right-hand check valve assembly 47 and finally from outlet port 11.

As drive shafts 31 move rightwardly, magnet 38 eventually passes the right-hand proximity sensor, whereupon the sensor is closed, thereby turning on transistor $Q_1$ and turning off transistor $Q_2$. When this occurs, the solenoid associated with the right-hand three-way valve is opened so as to exhaust air from air region 26 associated with pump assembly 2, while at the same time, the solenoid valve associated with the left-hand three-way valve is closed to admit air under pressure from a source not shown into the air region 26 associated with pump assembly 1. As this occurs, the left-hand diaphragm is moved leftwardly, carrying with it shafts 31. As this occurs, fluid is drawn into the right-hand fluid region 27 from inlet port 12 through the lower right-hand check valve assembly, and fluid is exhausted from the left-hand fluid chamber through the upper left-hand check valve assembly and finally through outlet port 11. This operation continues for as long as power is applied to the pump.

It should be observed that the present invention is particularly well suited to provide smooth continuous operation. For example, the present invention utilizes electronic switching activated by magnet 38 and proximity sensors 39 which allow for instantaneous detection that shafts 31 have reached their established limits of travel in either direction. In addition, the detection of the pump reversal points by electronic means eliminates interference by oil or dirt in the air supply that could occur with diaphragm pumps utilizing air pressure or airflow feedback systems to control operation of the pumping mechanism.

It will also be observed that the mounting of the three-way air control valves 45 in close proximity to air regions 26 also minimizes the amount of air which must be moved, thereby decreasing the response time. In other words, the total volume of air which must be pressurized or depressurized is minimized, thus permitting rapid reversal of the shafts 31.

In addition, linking means 34 joining the innermost ends of shafts 31 eliminates the possibility that the bushing assemblies 32 may not be precisely co-axial, and also eliminates binding that might otherwise occur with a continuous single shaft extending between the left-hand and right-hand diaphragms.

It will also be apparent in the present invention that the upper and lower check valve assemblies are easily accessible for repair or replacement by merely removing the associated closure 13 or 19. In addition, this accessibility also permits the pump to be easily drained before disassembly simply by removing the lower closures 13.

Another important feature of the present invention is the ease with which the entire pump may be assembled and disassembled for maintenance. In general, diaphragms 25 typically are the parts which require most frequent replacement as a result of wear. The bushing assemblies 32 and seal 33 also are subject to wear and may eventually require replacement if air leakage from the air chamber develops. With the present invention, each individual pump assembly 1 and 2 can be removed and easily replaced. It will also be noted that the symmetrical design of the unit minimizes the number of different parts which must be manufactured. Disassembly of the pump may be carried out by merely disconnecting the shaft linkage 34 and removing the retainer bolts 42. Each entire pump assembly then can be removed from the manifold frame and replaced by a new or reconditioned pump assembly. Consequently, the diaphragm pump can be returned to operation with little down time, and the faulty pump assembly easily repaired apart from the pump itself.

It will be understood that various changes in the parts, details, steps and operations may be made within the scope of the present invention as expressed in the appended claims.

The embodiments of the invention in which an exclusive property or privilege is claimed are as follows:

1. A double-acting air-powered diaphragm pump comprising:

a manifold assembly having inlet and outlet manifold members, said inlet manifold having a fluid inlet port, said outlet manifold having a fluid outlet port;

first and second diaphragm pump assemblies positioned in spaced relationship, each of said pump assemblies having a cavity-like pump chamber, a resilient web-like diaphragm positioned within said pump chamber to define an air chamber and a fluid chamber, and a shaft member having one end attached to the central portion of said diaphragm;

said manifold assembly further including first connecting means for permitting fluid flow from said inlet port to said fluid cavity when said diaphragm moves so as to increase the volume of said fluid cavity, and second connecting means for permitting fluid flow from said fluid cavity to said outlet port when said diaphragm moves so as to decrease the volume of said fluid cavity;

means for removably attaching said pump assemblies to said manifold assembly so that said diaphragms are substantially parallel and said shaft members are substantially co-axial;

means for pivotally and detachably connecting said other ends of the shaft members to cause the shaft members to reciprocate together; and means for pressurizing and exhausting air from each of said air chambers so as to alternately increase and decrease, respectively, the volume of said air cavities to cause fluid to be moved from the inlet port to the outlet port, whereby said pump assemblies can be easily and individually removed from said pump.

2. The apparatus according to claim 1 wherein said manifold members are spaced apart, said pump assemblies being positioned between said manifold members.

3. The apparatus according to claim 1 wherein said shaft connecting means comprises a rigid chain link member detachably joining said other end of the shafts.

4. The apparatus according to claim 1 wherein said first and second pump assemblies are substantially identical.

5. The apparatus according to claim 1 wherein said manifold members are spaced apart, said pump assemblies being positioned between said manifold members, said first and second pump assemblies being substantially identical, said shaft connecting means comprising a rigid chain link member detachably joining said other ends of the shafts.

6. A double-acting air-power diaphragm pump comprising:

a frame-like manifold assembly having spaced apart inlet and outlet manifold members and end members joining the respective ends of said manifold members, said inlet manifold member having a fluid inlet passageway therewithin and a fluid inlet port communicating with said inlet passageway, said outlet manifold member having an outlet passageway therewithin and a fluid outlet port communicating with said outlet passageway, each of said end members having first and second fluid passageways therewithin, said first passageway communicating with said inlet passageway, said second passageway communicating with said outlet passageway;

first and second diaphragm pump assemblies positioned in spaced relationship between said manifold members, each of said pump assemblies including first and second pump assembly members mated together so as to define a cavity-like pump chamber therewithin, a resilient web-like diaphragm positioned within said pump chamber to define an air chamber and a fluid chamber on either side of said diaphragm, said first pump assembly member including a pair of passageways for connecting, respectively, said first and second passageways to said fluid chamber, and an elongated shaft member having one end attached to the central portion of said diaphragm;

check valve means positioned in said first passageway for permitting fluid flow from said fluid inlet port to said fluid chamber but preventing fluid flow in the opposite direction, and check valve means positioned in said second passageway for permitting fluid flow from said fluid chamber to said fluid outlet port but preventing fluid flow in the opposite direction;

means for removably attaching each of said pump assemblies to said end members so that said diaphragms are substantially parallel and said shaft members are substantially co-axial;

means for removably and detachably connecting said other ends of the shaft members to cause the shaft members to reciprocate axially together; and valve means for pressurizing and exhausting air from each of said air chambers so as to aternately increase and decrease, respectively, the volume of said air cavities to cause fluid to be moved from the inlet port to the outlet port.

7. The apparatus according to claim 6 wherein said shaft connecting means comprises a rigid chain link detachably joining said other ends of the shaft.

8. The apparatus according to claim 6 wherein the peripheral edge of said diaphragm is removably retained between mating surfaces of said pump assembly members.

9. The apparatus according to claim 6 including means for removing said check valve means from said end members.

10. The apparatus according to claim 6 including means for sensing the position of said shaft members and control means responsive to said sensing means for operating said valve means when the shaft members reach predetermined points of travel.

11. The apparatus according to claim 10 wherein said control means includes means for pressurizing a first one of said air chambers and for exhausting air from a second one of said air chambers when the shaft members reciprocate to a first predetermined position, and for pressurizing said second air chamber and for exhausting air from said first air chamber when the shaft members reciprocate to a second predetermined position.

12. The apparatus according to claim 6 wherein said first and second pump assemblies are substantially identical.

13. The apparatus according to claim 6 wherein said shaft connecting means comprises a rigid chain link member detachably joining said shafts, the peripheral edge of said diaphragm being removably retained between mating surfaces of said pump assembly members, and further including means for removing said check valve means from said end members.

14. The apparatus according to claim 13 wherein said first and second pump assemblies are substantially identical.

15. The apparatus according to claim 14 including means for sensing the position of said shaft members and control means responsive to said sensing means for operating said valve means when the shaft members reach predetermined points of travel.

16. The apparatus according to claim 15 wherein said control means includes means for pressurizing a first one of said air chambers and for exhausting air from a second one of said air chambers when the shaft members reciprocate to a first predetermine position, and for pressurizing said second air chamber and for exhausting air from said first air chamber when the shaft members reciprocate to a second predetermined position.

* * * * *